US009980066B2

(12) United States Patent
Nagl et al.

(10) Patent No.: US 9,980,066 B2
(45) Date of Patent: May 22, 2018

(54) BONE CONDUCTION TRANSDUCER SYSTEM WITH ADJUSTABLE RETENTION FORCE

(71) Applicant: MED-EL Elektromedizinische Geraete GmbH, Innsbruck (AT)

(72) Inventors: Markus Nagl, Volders (AT); Thomas Lechleitner, Polling (AT); Günther Weidenholzer, Sarleinsbach (AT)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 98 days.

(21) Appl. No.: 15/267,214

(22) Filed: Sep. 16, 2016

(65) Prior Publication Data

US 2017/0086002 A1 Mar. 23, 2017

Related U.S. Application Data

(60) Provisional application No. 62/220,286, filed on Sep. 18, 2015.

(51) Int. Cl.
*H04R 25/00* (2006.01)

(52) U.S. Cl.
CPC ..... *H04R 25/65* (2013.01); *H04R 25/554* (2013.01); *H04R 25/606* (2013.01)

(58) Field of Classification Search
CPC ..... H04R 25/554; H04R 25/606; H04R 25/65
See application file for complete search history.

(56) References Cited

U.S. PATENT DOCUMENTS 4,628,907 A 12/1986 Epley
5,554,096 A 9/1996 Ball
2001/0055405 A1 12/2001 Cho

FOREIGN PATENT DOCUMENTS

WO WO 2014/039743 3/2014

OTHER PUBLICATIONS

International Searching Authority, Authorized Officer Shane Thomas, International Search Report and Written Opinion, PCT/US16/52035, dated Dec. 20, 2016, 14 pages.

*Primary Examiner* — Christine H Matthews
(74) *Attorney, Agent, or Firm* — Sunstein Kann Murphy & Timbers LLP

(57) ABSTRACT

An external component for a bone conduction hearing implant is described. An external housing contains an electromagnetic drive coil, a coil core, and at least one spacer container located adjacent to one of the longitudinal ends of the coil core and configured to hold an optional removable spacer piece. The coil core and any pole pieces and side pieces are configured to magnetically interact with an implant magnet in the bone conduction transducer in the absence of electrical current in the drive coil to hold the external housing in the fixed attachment on the skin of the hearing implant patient over the bone conduction transducer. And electrical current in the drive coil magnetically interacts with the coil core and any pole pieces and side pieces to generate the implant communication signals to the implant magnet to create a mechanical vibration signal in the bone conduction transducer for perception by the patient as sound.

11 Claims, 5 Drawing Sheets

BONE CONDUCTION TRANSDUCER SYSTEM WITH ADJUSTABLE RETENTION FORCE

This application claims priority from U.S. Provisional Patent Application 62/220,286, filed Sep. 18, 2015, which is incorporated herein by reference in its entirety.

FIELD OF THE INVENTION

The present invention relates to medical implants, and more specifically, to a novel bone conduction hearing implant system.

BACKGROUND ART

A normal ear transmits sounds as shown in FIG. 1 through the outer ear 101 to the tympanic membrane 102 which moves the ossicles of the middle ear 103 that vibrate the oval window 106 and round window 107 membranes of the cochlea 104. The cochlea 104 is a long narrow duct wound spirally about its axis for approximately two and a half turns. The cochlea 104 forms an upright spiraling cone with a center called the modiolar where the spiral ganglion cells of the cochlear nerve 105 reside. In response to received sounds transmitted by the middle ear 103, the fluid-filled cochlea 104 functions as a transducer to generate electric pulses which are transmitted by the cochlear nerve 105 to the brain.

Hearing is impaired when there are problems in the ability to transduce external sounds into meaningful action potentials along the neural substrate of the cochlea. To improve impaired hearing, auditory prostheses have been developed. For example, when the impairment is related to operation of the middle ear, a conventional hearing aid, a middle ear implant, or a bone conduction implant may be used to provide acoustic-mechanical stimulation to the auditory system in the form of amplified sound. Or when the impairment is associated with the cochlea, a cochlear implant with an implanted stimulation electrode can electrically stimulate auditory nerve tissue with small currents delivered by multiple electrode contacts distributed along the electrode.

U.S. Patent Publication 20070191673 (incorporated herein by reference in its entirety) describes one type of bone conduction implant that delivers a mechanical vibration signal to the cochlea for sound perception in persons with conductive or mixed conductive/sensorineural hearing loss. An implanted bone conduction transducer is affixed beneath the skin to the temporal bone. In response to an externally generated electrical communications signal, the transducer couples a mechanical stimulation signal to the temporal bone for delivery by bone conduction to the cochlea for perception as a sound signal. A certain amount of electronic circuitry also is implanted with the transducer to provide power to the implanted device and at least some signal processing which is needed for converting the external electrical communications signal into the mechanical stimulation signal and mechanically driving the transducer.

Bone conduction implant systems that have the vibration driving unit in the external device face the problem that the external device itself, which is magnetically held, also vibrates. That makes the external device more prone to fall off the patient than the external portions of cochlear implant systems. There needs to be a delicate matching of the amount of magnetic attraction force that holds the external device over the implant, together with the amount of vibration force needed for hearing perception. This matching has been attempted in prior art devices by using magnets in the external device which can be moved closer to or further away from the implantable magnet so as to adjust the amount of overall magnetic force. In other prior art arrangements, a stack of magnets was used in the external device rather than just a single magnet. Depending on the magnetic force that is actually needed, one or more of the magnets are used.

SUMMARY OF THE INVENTION

Embodiments of the present invention include an external component for a bone conduction hearing implant. An external housing is fixedly attachable on the skin of a hearing implant patient over an implanted bone conduction transducer. A housing interior is located within the external housing and contains: i. an electromagnetic drive coil fixed within the housing interior and configured for conducting electrical current to develop implant communication signals for the bone conduction transducer, ii. a coil core made of a non-magnetized ferromagnetic material fixed within the drive coil, the coil core including opposing longitudinal ends and opposing longitudinal sides, and iii. at least one spacer container, wherein the first spacer container is configured to hold an optional first removable spacer piece. The housing interior further includes at least one of: i. a pair of opposing pole piece containers located adjacent to the opposing longitudinal ends of the coil core and any spacer containers, each pole piece container being configured to hold an optional removable ferromagnetic pole piece, and ii. a pair of opposing side piece containers located at the opposing longitudinal sides of the coil core, each side piece container being configured to hold an optional removable side piece made of ferromagnetic material or being a permanent magnet. The coil core and any pole pieces and side pieces are configured to magnetically interact with an implant magnet in the bone conduction transducer in the absence of electrical current in the drive coil to hold the external housing in the fixed attachment on the skin of the hearing implant patient over the bone conduction transducer. And electrical current in the drive coil magnetically interacts with the coil core and any pole pieces and side pieces to generate the implant communication signals to the implant magnet to create a mechanical vibration signal in the bone conduction transducer for perception by the patient as sound.

In some embodiments, the housing interior may include a pair of spacer containers, one at each longitudinal end of the coil core, wherein each spacer container is configured to hold an optional removable spacer piece. In addition or alternatively, the removable spacer piece may be ferromagnetic or permanently magnetized so that the coil core, the removable spacer piece, and any pole pieces and side pieces are configured to magnetically interact with an implant magnet in the bone conduction transducer in the absence of electrical current in the drive coil to hold the external housing in the fixed attachment on the skin of the hearing implant patient over the bone conduction transducer; and so that electrical current in the drive coil magnetically interacts with the coil core, the removable spacer piece, and any pole pieces and side pieces to generate the implant communication signals to the implant magnet to create a mechanical vibration signal in the bone conduction transducer for perception by the patient as sound.

The coil core may have a rectangular block shape, for example, with a width and a height, both of which are less than the diameter of the implant magnet. The rectangular block shape may have a length configured so that the length together with the pole piece containers and spacer container(s) is greater than the diameter of the implant magnet.

The external component also may include a signal processor for generating coil drive signals for the drive coil. The housing interior may include the pole piece containers, which are further configured so that any optional removable ferromagnetic pole piece will have a lower surface closer to the skin of the hearing implant patient than a corresponding lower surface of the coil core. The pole piece containers may be further configured so that any optional removable ferromagnetic pole piece will have an upper surface that lies in a common plane with a corresponding upper surface of the coil core.

In specific embodiments, the external component may be configured to magnetically interact with a freely rotatable disk-shaped implant magnet with a magnetic dipole moment oriented across a diameter of the implant magnet substantially parallel to the skin of the hearing implant patient.

Embodiments of the present invention also include a bone conduction hearing implant system having an external component according to any of the foregoing.

DETAILED DESCRIPTION OF SPECIFIC EMBODIMENTS

In a bone conduction hearing system, the external device and the implanted portions of the system are separated by a flap of skin that varies in thickness from one patient to another, in extreme cases, between 2 mm and 10 mm (or even more). Embodiments of the present invention are directed to a modular magnetic arrangement for an external device of a bone conduction hearing implant system, which provides an adjustable force of magnetic attraction between the implanted portion and the external device while maintaining an appropriate vibration force between the two components sufficient to realize the bone conduction function of the system as a whole. As explained below, some of the structural elements may contribute more to the holding force, while others contribute more towards the vibration force.

Figure 1:
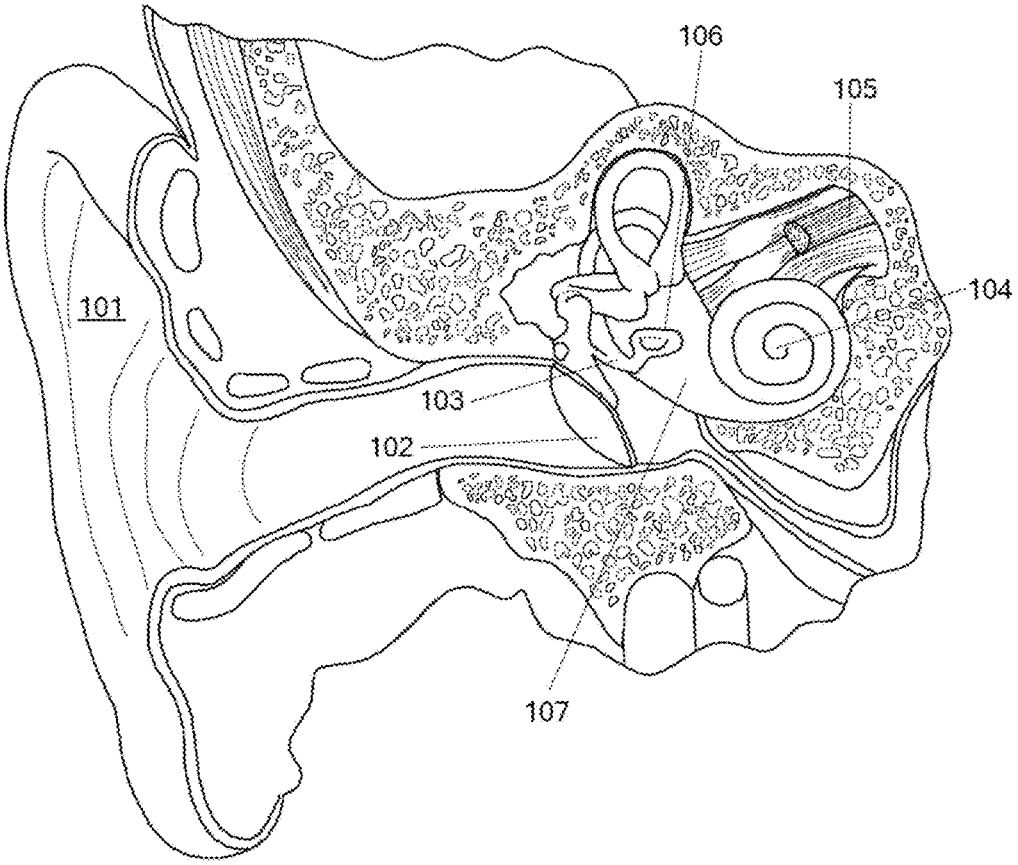
FIG. 1 shows anatomical structures of a typical human ear.
Figure 2:
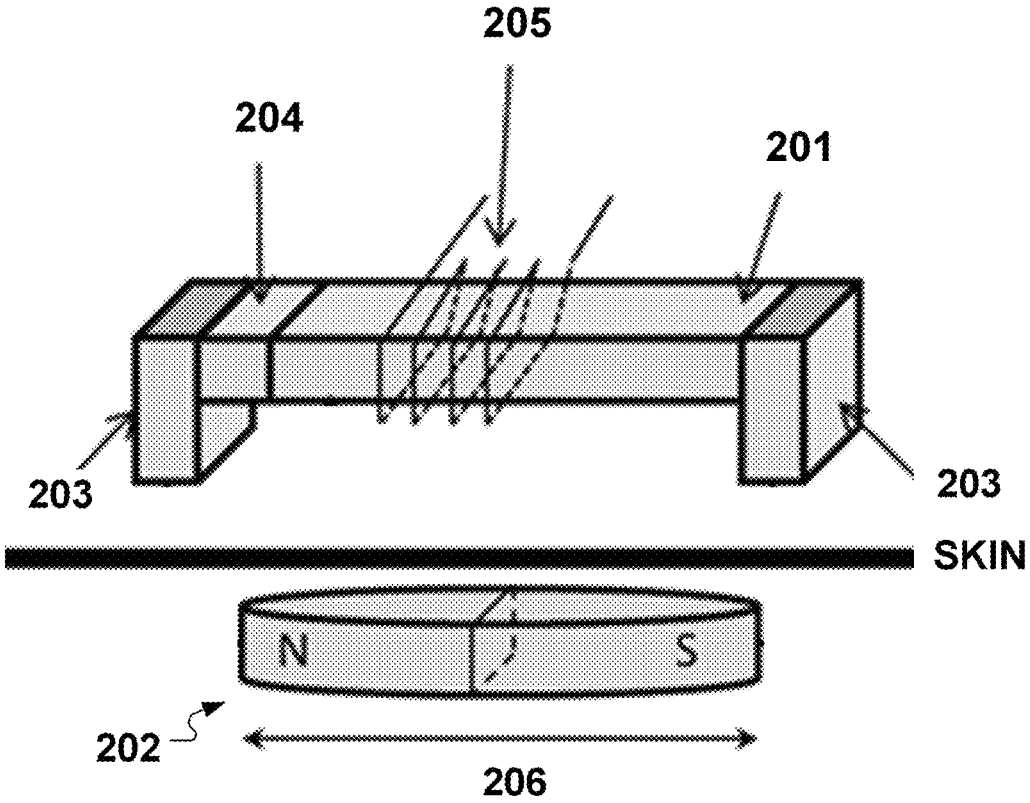
FIG. 2 shows a simplified perspective view of various structural elements of an external component magnet arrangement according to an embodiment of the present invention.

FIG. 2 shows a simplified perspective view of various structural elements of one specific embodiment of a magnetic arrangement for an external device of a bone conduction hearing implant. An electromagnetic drive coil 205 conducts electrical current to develop implant communication signals for an implanted bone conduction transducer. A coil core 201 is made of a non-magnetized ferromagnetic material—e.g., soft iron, ferromagnetic stainless steel variants, soft ferromagnetic composite material, etc.—and fixed within the drive coil 205. In specific embodiments, the coil core 201 may have various selected specific shapes, such as a rectangular block shape, for example, with a width and a height, both of which are less than the diameter 206 of the implant magnet 202.

Various optional modular structural elements may be arranged adjacent to the coil core 201—for example, at opposing longitudinal ends, at opposing longitudinal sides, etc.—to form, together with the coil core 201 itself, a magnetic yoke assembly. FIG. 2 shows examples of such possible optional modular structural elements, including pole pieces 203 at each of the opposing longitudinal ends of the coil core 201, and a spacer element 204 located between one of the pole pieces 205 and one end of the coil core 201. The pole pieces 203 and spacer element 204 are made of ferromagnetic material which may be the same material as the coil core 201, or different ferromagnetic material. Typically, both the pole pieces 203 and spacer element 204 are not permanently magnetized, though in some embodiments, it is possible that the spacer element 204 could usefully be made of non-magnetic material or permanently magnetized material.

Current flow through the drive coil 205 generates an electromagnetic field that interacts with the yoke assembly—the coil core 201, spacer element 204, and pole pieces 203—to generate the implant communication signals to the implant magnet 202. The rectangular block shape of the coil core 201 may have a specific length that together with the pole pieces 203 and spacer element 204 is greater than the diameter 206 of the implant magnet 202. For example, the overall combined length of the coil core 201, the pole pieces 203, and spacer element 204 may be controlled so that the lines of magnetic flux between the lower surfaces of the pole pieces 203 and the outer circumference of the implant magnet 202 are as short as possible.

Figure 3:
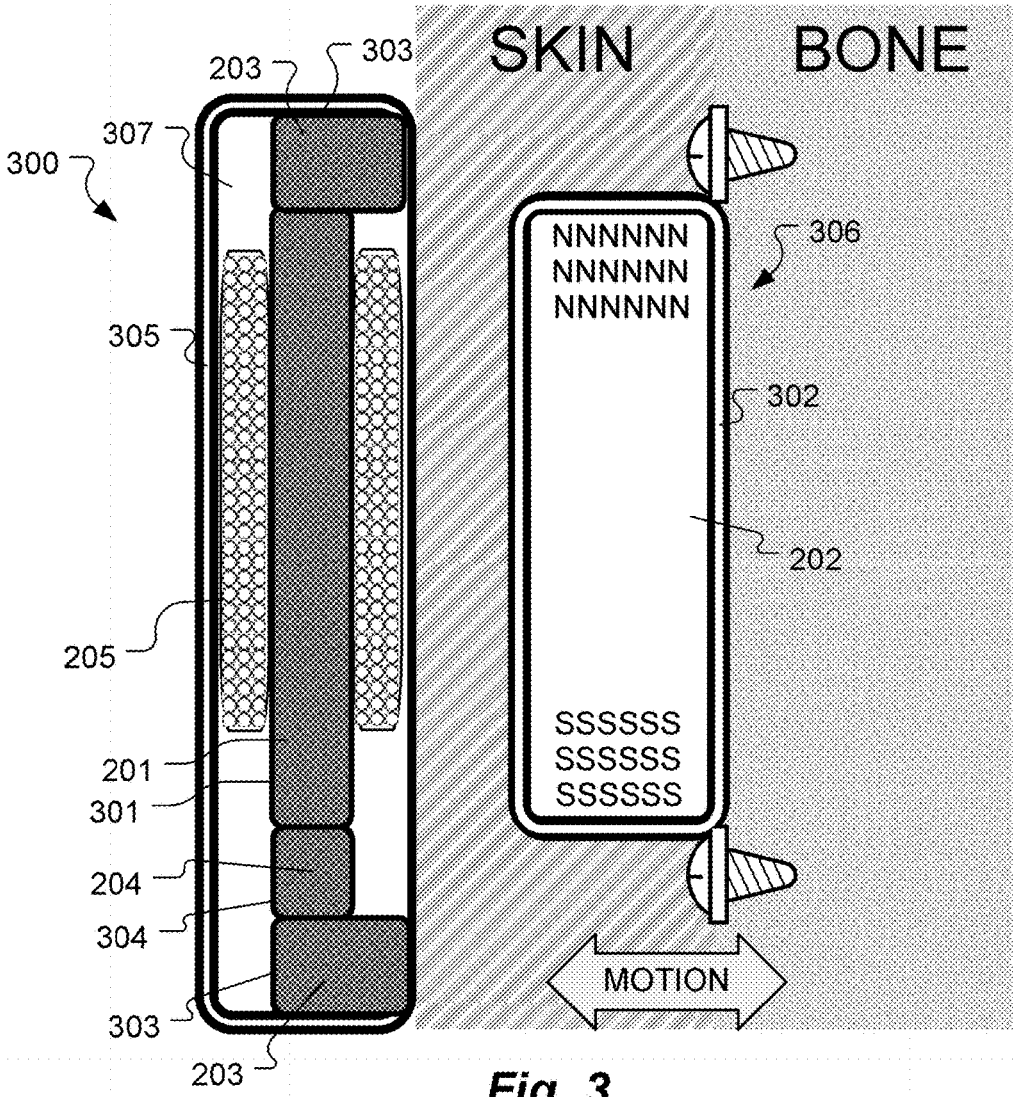
FIG. 3 shows a side view of a bone conduction hearing implant system using an external device magnet arrangement as in FIG. 2.

FIG. 3 shows a side view of a bone conduction hearing implant system using an external device magnet arrangement as in FIG. 2. The external device 300 includes an external housing 305 that is fixedly attachable on the skin of a hearing implant patient over an implanted bone conduction transducer 306. The external housing 305 has a housing interior 307 that contains a drive coil 205 and modular magnetic yoke arrangement as shown in FIG. 2. The drive coil 205 contains the coil core 201, which may be enclosed within its own core container 301. At the opposing longitudinal ends of the coil core 201 are a pair of opposing pole piece containers 303. Each pole piece container 303 is configured to hold an optional removable ferromagnetic pole piece 203.

In the specific embodiment shown in FIG. 3, there also is a similar spacer container 304 located between one longitudinal end of the coil core 201 and a corresponding pole piece container 304. The spacer container 304 is configured to hold an optional removable spacer piece. In other specific embodiments, there may also be a another spacer container located between the other longitudinal end of the coil core 201 and a corresponding pole piece container 304, for holding another optional second removable spacer piece.

The coil core 201 and any pole pieces 203 and/or spacer pieces 204 are configured to magnetically interact with an implant magnet 202 (which may be enclosed in its own implant magnet container 302) in the bone conduction transducer 306 in the absence of electrical current in the drive coil 201 to hold the external device 300 in the fixed attachment on the skin of the hearing implant patient over the bone conduction transducer 306. Electrical current that is generated in the drive coil 201 (e.g., by a signal processor and related electronic circuitry, not shown) magnetically interacts with the coil core 201 and any pole pieces 203 and/or spacer pieces 204 to create a mechanical vibration signal in the bone conduction transducer 306 (which is entirely passive without additional electronic circuitry) for perception by the patient as sound.

In the specific housing interior 307 shown in FIG. 3, the pole piece containers 303, and the removable optional pole pieces 203 they may contain, have a lower surface that is closer to the skin of the hearing implant patient, and the implanted bone conduction transducer 306, than a corresponding lower surface of the coil core 201. By contrast, their upper surfaces (as well as that of the spacer container 304 and its removable optional spacer element 204) all lie in a common plane.

The bone conduction transducer 306 may have a freely rotatable disk-shaped implant magnet 202 with a magnetic dipole moment as described in U.S. Pat. No. 8,634,909 (incorporated herein by reference in its entirety) and shown in FIG. 3 that is oriented across a diameter of the implant magnet 202 substantially parallel to the skin of the hearing implant patient.

Figure 4:
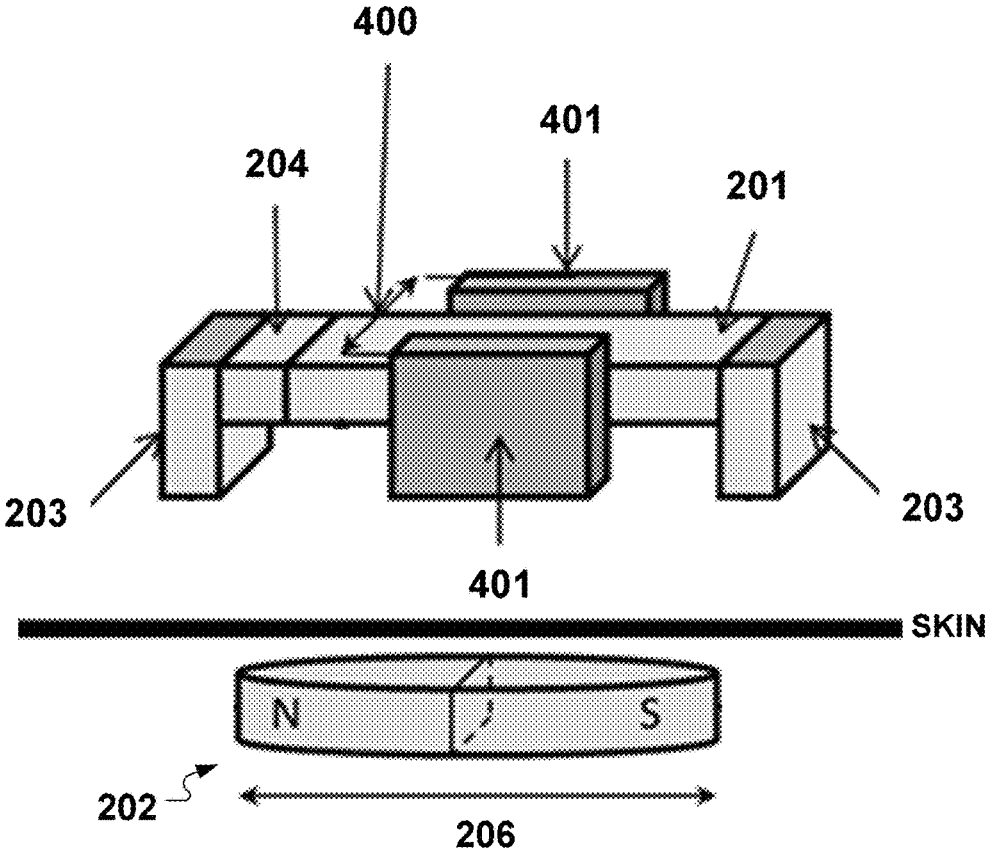
FIG. 4 shows a simplified perspective view of various structural elements of an external component according to another embodiment of the present invention.

FIG. 4 shows a simplified perspective view of various structural elements of an external component according to another embodiment of the present invention which includes optional removable modular side pieces 401, which are held in their own corresponding side piece containers (not shown in FIG. 4 for clarity). The side pieces 401 are located at the opposing longitudinal sides of the coil core 201. Although not visible in the simplified form of FIG. 4, there may be a coil gap separating the side elements 401 and the coil core 201, which allows the wires of the drive coil 205 to be wound around the coil core 201. The coil core 201 may assume other different forms than a rectangular bock, but in any case the same orientation of wiring in the drive coil 205 should be supported. For example, the various different faces of the coil core 201 may be square, or concave or convex and/or one side may be longer or shorter and/or there may be one or more recesses to receive the wound wires of the drive coil 205.

The side pieces 401 may be made of unmagnetized ferromagnetic material, which may be the same material as the coil core 201, or different ferromagnetic material, or they may be permanently magnetized ferromagnetic material. If both the side pieces 401 and the spacer element 204 are permanent magnets, then the magnetic dipoles of both components should be aligned to be parallel with the same orientation.

As shown in FIG. 4, the lower surface of the side elements 401 and the lower surfaces of the pole pieces 203 may be in the same plane, while the upper surfaces of the side pieces 401 may extend above the upper surface of the coil core 201. The width distance 400—the thickness of the side pieces 401 plus the width of the coil core 201, plus the coil gaps between them—may typically be greater than the diameter 206 of the implant magnet 202. In particular, the width distance 400 may be such that the magnetic flux lines between the lower surfaces of the side pieces 401 and the outer circumference of the implant magnet 202 are as short as possible.

The drive coil 205 (not shown in FIG. 4 for clarity) is wound around the coil core 201 so that current flow generates a coil magnetic field that is parallel or anti-parallel to the magnetic field of the implant magnet 201 and to the optional modular side pieces 401 and/or the spacer element 204, if they are permanent magnets as well. The varying magnetic field transfer for the vibration signal caused by the coil magnetic field is mainly supported by on the main yoke elements of the coil core 201 together with the spacer element 204 and pole pieces 203, whereas the static magnetic field to hold the external device in place that exists without current flow through the drive coil 205, is supported by both the yoke elements together with the geometric arrangement of the side elements 401.

The magnet arrangement in any of the foregoing allows selecting a great variety of different magnetic attraction forces depending on the actual choice of modular elements: e.g. the core element only, core element with side elements, core element with pole pieces and non-magnetic spacer element, core element with pole pieces and a spacer element of an unmagnetized ferromagnetic material, core element with pole pieces and a spacer element of permanently magnetized ferromagnetic material, core element with pole pieces and a spacer element (in one of the above configurations) plus side elements, etc.

Figure 5:
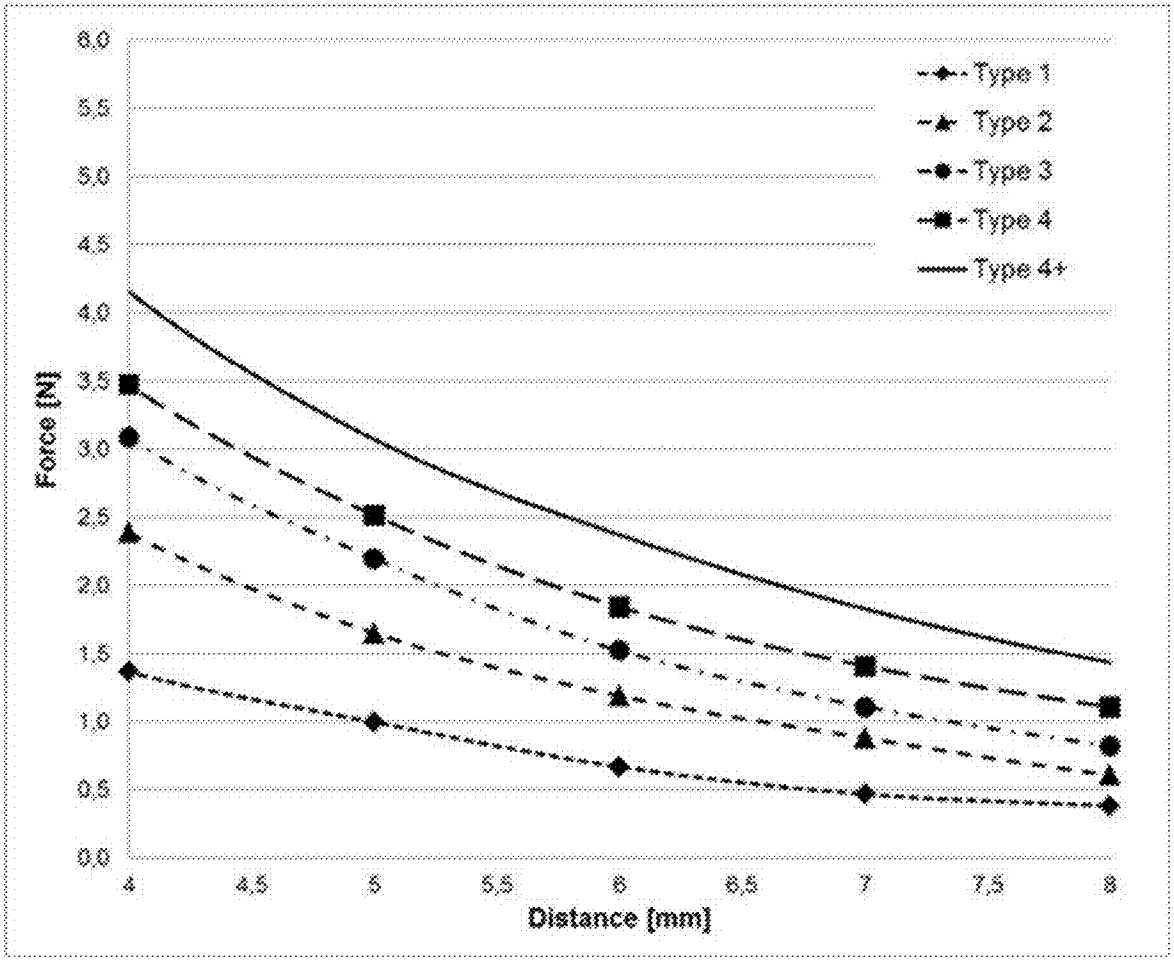
FIG. 5 shows a graph of attraction force of the implant magnet relative to various configurations of the external device according to embodiments of the present invention.

FIG. 5 shows the magnetic attraction force of the implantable magnet relative to the external magnet arrangement as a function of separation distance for various modular configurations. The lowest curve labelled Type 1 is where there are no optional modular elements, just a coil core. The curve above that labelled Type 2 is for a coil core with pole pieces and non-magnetic spacer element. The Type 3 curve is for the same arrangement, where the spacer element is of unmagnetized ferromagnetic material, and the Type 4 curve is for the same arrangement with a permanent magnet spacer element. The Type 4+ curve on top is for the Type 4 configuration with the addition of side pieces made of permanent magnets.

Although various exemplary embodiments of the invention have been disclosed, it should be apparent to those skilled in the art that various changes and modifications can be made which will achieve some of the advantages of the invention without departing from the true scope of the invention.

What is claimed is:

1. An external component for a bone conduction hearing implant system, the component comprising:

an external housing for fixed attachment on the skin of a hearing implant patient over an implanted bone conduction transducer;

a housing interior located within the external housing and containing:

i. an electromagnetic drive coil fixed within the housing interior and configured for conducting electrical current to develop implant communication signals for the bone conduction transducer, ii. a coil core made of a non-magnetized ferromagnetic material fixed within the drive coil, the coil core including opposing longitudinal ends and opposing longitudinal sides, and iii. at least one spacer container located adjacent to one of the longitudinal ends of the coil core and configured to hold an optional removable spacer piece;

wherein the housing interior further comprises at least one of:

i. a pair of opposing pole piece containers located adjacent to the opposing longitudinal ends of the coil core and any spacer containers, each pole piece container being configured to hold an optional removable ferromagnetic pole piece, and ii. a pair of opposing side piece containers located at the opposing longitudinal sides of the coil core, each side piece container being configured to hold an optional removable ferromagnetic side piece;

wherein the coil core and any pole pieces and side pieces are configured to magnetically interact with an implant magnet in the bone conduction transducer in the absence of electrical current in the drive coil to hold the external housing in the fixed attachment on the skin of the hearing implant patient over the bone conduction transducer; and wherein electrical current in the drive coil magnetically interacts with the coil core and any pole pieces and side pieces to generate the implant communication signals to the implant magnet to create a mechanical vibration signal in the bone conduction transducer for perception by the patient as sound.

2. The external component according to claim 1, wherein the coil core has a rectangular block shape.

3. The external component according to claim 2, wherein the rectangular block shape has a width and a height, both of which are less than a diameter of the implant magnet.

4. The external component according to claim 3, wherein the rectangular block shape has a length configured so that the length together with the pole piece containers, if any, is greater than the diameter of the implant magnet.

5. The external component according to claim 1, wherein the housing interior includes a pair of spacer containers, one at each longitudinal end of the coil core, wherein each spacer container is configured to hold an optional removable spacer piece.

6. The external component according to claim 1, wherein the removable spacer piece is ferromagnetic or permanently magnetized so that the coil core, the removable spacer piece, and any pole pieces and side pieces are configured to magnetically interact with an implant magnet in the bone conduction transducer in the absence of electrical current in the drive coil to hold the external housing in the fixed attachment on the skin of the hearing implant patient over the bone conduction transducer; and so that electrical current in the drive coil magnetically interacts with the coil core, the removable spacer piece, and any pole pieces and side pieces to generate the implant communication signals to the implant magnet to create a mechanical vibration signal in the bone conduction transducer for perception by the patient as sound.

7. The external component according to claim 1, further comprising:

a signal processor for generating coil drive signals for the drive coil.

8. The external component according to claim 1, wherein the housing interior includes the pole piece containers, which are further configured so that any optional removable ferromagnetic pole piece will have a lower surface closer to the skin of the hearing implant patient than a corresponding lower surface of the coil core.

9. The external component according to claim 8, wherein the pole piece containers are further configured so that any optional removable ferromagnetic pole piece will have an upper surface that lies in a common plane with a corresponding upper surface of the coil core.

10. The external component according to claim 1, wherein the external component is configured to magnetically interact with a freely rotatable disk-shaped implant magnet with a magnetic dipole moment oriented across a diameter of the implant magnet substantially parallel to the skin of the hearing implant patient.

11. A bone conduction hearing implant system having an external component according to any of claims 1-10.

* * * * *